US007802510B2

(12) United States Patent
Joubert

(10) Patent No.: US 7,802,510 B2
(45) Date of Patent: Sep. 28, 2010

(54) AMMUNITION LOADING ASSEMBLY

(75) Inventor: Francois Alwyn Joubert, Pretoria (ZA)

(73) Assignee: Denel (Pty) Ltd., Pretoria (ZA)

( * ) Notice: Subject to any disclaimer, the term of this patent is extended or adjusted under 35 U.S.C. 154(b) by 287 days.

(21) Appl. No.: 10/562,264

(22) PCT Filed: Jun. 30, 2004

(86) PCT No.: PCT/IB2004/051062

§ 371 (c)(1),
(2), (4) Date: Apr. 27, 2006

(87) PCT Pub. No.: WO2005/003672

PCT Pub. Date: Jan. 13, 2005

(65) Prior Publication Data

US 2006/0236852 A1 Oct. 26, 2006

(30) Foreign Application Priority Data

Jul. 2, 2003 (ZA) ..... 03/5146

(51) Int. Cl.
*F41A 9/16* (2006.01)

(52) U.S. Cl. ..... 89/45

(58) Field of Classification Search ..... 89/47, 89/45, 9, 11, 33.01, 33.5
See application file for complete search history.

(56) References Cited

U.S. PATENT DOCUMENTS 682,100 A * 9/1901 Matthews ..... 89/47
800,021 A * 9/1905 Schneider ..... 89/47
804,243 A * 11/1905 Meigs et al. ..... 89/47
889,321 A 6/1908 Meigs et al.
904,966 A 11/1908 Knoch
925,819 A * 6/1909 Meigs et al. ..... 89/47
932,034 A * 8/1909 Krone ..... 89/47
980,181 A 1/1911 Asbury
987,513 A * 3/1911 Vogeler ..... 89/47
3,727,515 A * 4/1973 Nelson et al. ..... 89/47
3,742,775 A * 7/1973 Hayes et al. ..... 89/47
4,481,862 A * 11/1984 Wiethoff et al. ..... 89/46
4,719,840 A * 1/1988 Goodell et al. ..... 89/47
4,727,790 A * 3/1988 DeHaven et al. ..... 89/46
5,277,097 A * 1/1994 Pehker ..... 89/47
5,895,880 A 4/1999 Golden
6,467,389 B1 * 10/2002 Baus et al. ..... 89/47
6,772,669 B1 * 8/2004 Stalhandske et al. ..... 89/47

OTHER PUBLICATIONS

International Search Report for PCT/IB2004/051062 dated Aug. 25, 2004.

* cited by examiner

*Primary Examiner*—Michael Carone
*Assistant Examiner*—Jonathan C Weber
(74) *Attorney, Agent, or Firm*—Nixon & Vanderhye P.C.

(57) ABSTRACT

An ammunition loading assembly (10) is disclosed for loading a projectile (12) into a barrel (14) of a gun. The assembly includes an urging member (16) for urging the projectile (12) into the barrel (14) and a drive means (18) for driving the urging member (16) between a projectile receiving position outside the barrel (14) and a projectile delivery position inside the chamber (20) of the gun. The drive means (18) includes a drive chain assembly (22) that moves the urging member (16) between the projectile receiving position and the projectile delivery position, so that the projectile is released just before the barrel engraving and engraves on it's own momentum. The assembly further includes first and second chain-retaining devices (42, 44) for limiting curving of the chain assembly and guiding the chain when moving out of the magazine.

13 Claims, 6 Drawing Sheets

AMMUNITION LOADING ASSEMBLY

This application is the US national phase of International Application No. PCT/IB2004/051062 filed 30 Jun. 2004, which designated the U.S. and claims priority to South African Application No. 2003/5146, filed 2 Jul. 2003, the entire contents of each of which are incorporated herein by reference.

INTRODUCTION AND BACKGROUND TO THE INVENTION

This invention relates to an ammunition loading assembly, a gun provided with such an ammunition loading assembly and a drive chain assembly for such an ammunition loading assembly.

A conventional flick rammer for loading a projectile into a barrel of a gun flicks the projectile, from a position outside the chamber, along the bore of the chamber into the bore of the barrel. A first disadvantage of such flick rammer is that, to enable engraving of the projectile in the barrel, concentric alignment of the projectile and the barrel is required, which is not always accurately achieved owing to the distance the projectile is flicked. This is aggravated at high elevations of the barrel.

A second disadvantage of the flick rammer is that if the energy with which the projectile is flicked into the barrel is insufficient, fall-back of the projectile occurs. This is especially so if the elevation of the barrel is greater that 45 degrees and where the concentric alignment of the projectile and barrel moves out of kilter during movement of the projectile along the chamber, resulting in the sides of the projectile bouncing against the insides of the chamber, thus reducing the kinetic energy thereof.

Furthermore, should the energy with which the projectile is flicked into the barrel be too much, bounce-back of the projectile occurs. Moreover, with a conventional flick rammer, the energy applied to the projectile is relatively difficult to control and the engraving depth of projectile is therefore inconsistent.

A further disadvantage of the conventional flick rammer is that it is not suitable for loading a charge into the chamber of the gun, as charges are often relatively soft and deform when flicked into the chamber. This could cause jamming of the breech.

U.S. Pat. No. 5,895,880 discloses a chain projectile rammer including a rammer pawl for engaging the base of a projectile with a rigidisable chain attached to the rammer pawl for providing reciprocating movement thereto. The rigidisable chain includes a plurality of rows of links having adjacent links pivotally attached to one another. A perimeter of each link enables fixed engagement of adjacent links on each row upon coordinated pivoting of adjacent links in each row. The perimeter of each link further enables release of the fixed engagement upon reverse coordinated pivoting of adjacent links. A drive is provided for reciprocally moving the chain and for pivoting adjacent links of the chain in order to rigidise the chain as the chain is moved in a forward direction and to unrigidise the chain when it is moved in a reverse direction.

A first disadvantage of this projectile rammer is that the construction of the chain is relatively complex making the chain prone to jamming. A second disadvantage is that ammunition rounds are not loaded into the barrel of the gun but into the breech, and is therefore suitable only for smaller caliber cased ammunition. Since the cased ammunition rounds are delivered only to the breech and not to barrel, the same disadvantages as to that of the flick rammer, discussed above are encountered with this type of rammer.

OBJECT OF THE INVENTION

It is therefore an object of the present invention to provide an ammunition loading assembly, a gun provided with such an ammunition loading assembly and a drive chain assembly for such an ammunition loading assembly with which the aforesaid disadvantages can be overcome or at least minimised.

SUMMARY OF THE INVENTION

According to a first aspect of the invention there is provided an ammunition loading assembly for loading a projectile into a barrel of a gun, comprising:

an urging member for urging the projectile into the said barrel; and a drive means for driving the urging member between a projectile receiving position outside the barrel and a projectile delivery position inside the chamber of the gun, towards the proximate end of the barrel, the drive means including a drive chain assembly, connected to the urging member for driving the urging member between the said projectile receiving and delivery positions.

Further according to the invention the drive chain assembly is rigid in all directions but one, the arrangement being such that the drive chain assembly pushes the urging member from the projectile receiving position to the projectile delivery position and pulls the urging member from the projectile deliver position to the projectile receiving position.

Further according to the invention, the ammunition loading assembly includes a magazine for storing the drive chain assembly when the urging member is in the projectile receiving position.

The magazine may define a curvilinear track along which the drive chain assembly moves when moving the urging member between the projectile delivery position and the projectile receiving position.

The magazine may include a polymeric body defining the track and which is covered by metal cover plates defining an outlet for the chain assembly. Preferably the polymeric block is of polypropylene.

The polymeric body may be provided with metal reinforcing members having curved chain guiding faces located at corners of the track, for guiding the inner end of the drive chain assembly around such corners.

The drive chain assembly may be constituted of a plurality of chain links pivotally connected to each other; and wherein each chain link may be provided with a retaining block for abutting the retaining block of a consecutive chain link for rigidising the drive chain assembly in all directions but one, the arrangement being such that when the drive chain assembly is bent in the said one direction, the retaining blocks are displaced from each other, and when the drive chain assembly is in a linear configuration, adjacent retaining blocks abut each other to limit bending of the drive chain assembly in all but said one direction.

The configuration of the retaining blocks may be such that, when the blocks abut each other, the drive chain assembly extends in a loose curve, the arrangement being further such that the drive chain assembly may be stressed by straightening the curve.

The retaining blocks may each comprise a base for connecting to a chain link and two abutment faces extending upwardly from the base, the configuration being such that the angle between the base and each abutment face is marginally greater than 90 degrees.

The drive means may further include a drive motor for driving the drive chain assembly.

The drive motor may include a drive sprocket wheel for engaging the links of the drive chain assembly.

The ammunition loading assembly may further include a first chain-retaining device for limiting curving of the chain assembly out of its linear orientation, when moving the urging member towards the projectile delivery position, the first chain-retaining device is movable with the urging member from the projectile receiving position towards a position intermediate the projectile receiving and delivery positions, where it is retained from further movement by a retaining means.

The ammunition loading assembly may yet further include a second chain-retaining device, for guiding the chain when moving out of the magazine.

The first and second chain-retaining devices may each be provided with at least one sliding member for engaging an upper surface of the retaining blocks of the chain assembly.

The sliding members may each comprise one or more polypropylene bodies.

The second chain-retaining device may be movable with the urging member in a direction towards the projectile delivery position, from a position proximate the outlet of the magazine to a position offset from the said outlet.

According to a second aspect of the invention there is provided a gun including an ammunition loading assembly according to the first aspect of the invention.

According to a third aspect of the invention there is provided a drive chain assembly for an ammunition loading assembly for loading a projectile into a barrel of a gun, the chain assembly comprising a plurality of chain links pivotally connected to each other; each chain link being provided with a retaining block for abutting the retaining block of a consecutive chain link for rigidising the drive chain assembly in all directions but one.

Further according to the invention, the arrangement is such that when the drive chain assembly is bent in the said one direction, the retaining blocks are displaced from each other, and when the drive chain assembly is in a linear configuration, adjacent retaining blocks abut each other to limit bending of the drive chain assembly in all but said one direction.

Yet further according to the invention, the configuration of the retaining blocks is such that, when the blocks abut each other, the drive chain assembly extends in a loose curve, the arrangement being further such that the drive chain assembly is stressed by straightening the curve.

The retaining blocks may each comprise a base for connecting to a chain link and two abutment faces extending upwardly from the base, the configuration being such that the angle between the base and each abutment face is marginally greater than 90 degrees.

BRIEF DESCRIPTION OF THE DRAWINGS

The invention will now be described further by way of a non-limiting example with reference to the accompanying drawings wherein.

DESCRIPTION OF A PREFERRED EMBODIMENT OF THE INVENTION

Figure 1:
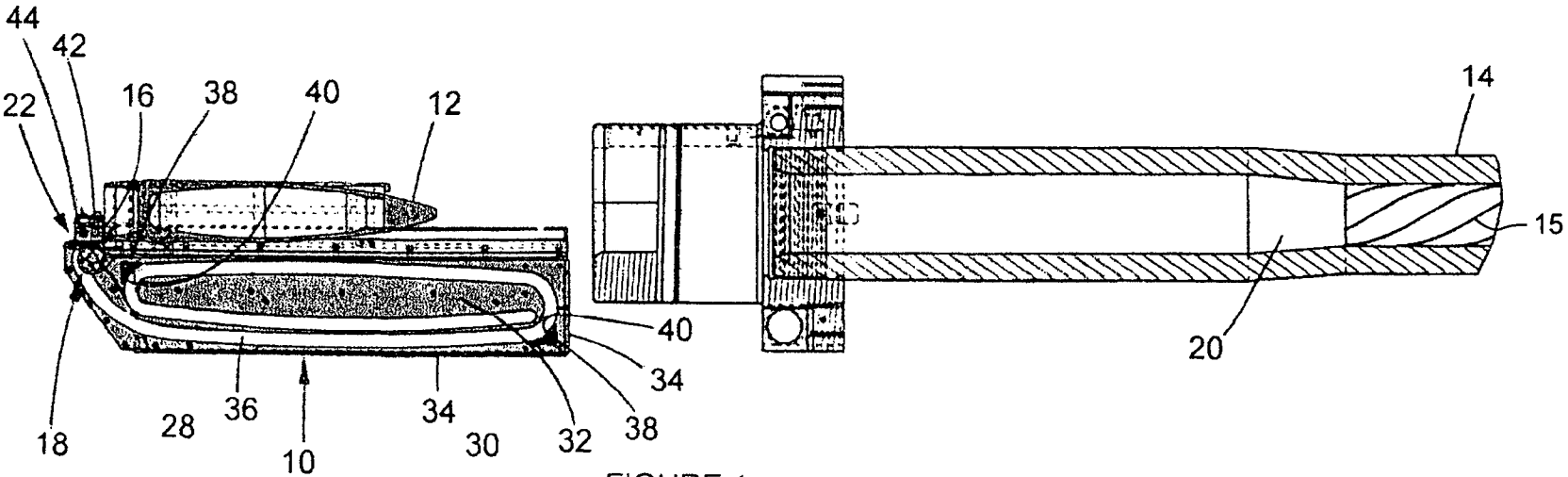
FIG. 1 is a longitudinal sectional side view of a barrel of a gun and of an ammunition loading assembly according to a preferred embodiment of the invention, with a projectile urging member in a projectile receiving position.

Referring to FIGS. 1 to 4, an ammunition loading assembly according to a preferred embodiment of the invention is generally designated by reference numeral 10.

The ammunition loading assembly 10 is suitable for loading a projectile 12 into a barrel 14 of a gun (not shown) and comprises an urging member 16 for urging the projectile 12 into the said barrel 14. The ammunition loading assembly 10 further includes a drive means 18 for driving the urging member 16 between a projectile receiving position (shown in FIG. 1) outside the barrel 14 and a projectile delivery position (shown in FIG. 2) inside the chamber 20 of the gun, towards the proximate end of the barrel 14. The drive means 18 includes a drive chain assembly 22, connected to the urging member 16 for driving the urging member 16 between the projectile receiving and delivery positions. The drive means 18 further includes a drive motor (not shown) for driving the drive chain assembly 22. The drive motor includes a drive sprocket wheel 28, as shown in detail in FIGS. 4 and 5, which engages the drive chain assembly 22.

The drive chain assembly 22 is rigid in all directions but one, the arrangement being such that the drive chain assembly 22 pushes the urging member 16 from the projectile receiving position to the projectile delivery position and pulls the urging member 16 from the projectile deliver position to the projectile receiving position.

Figure 6:
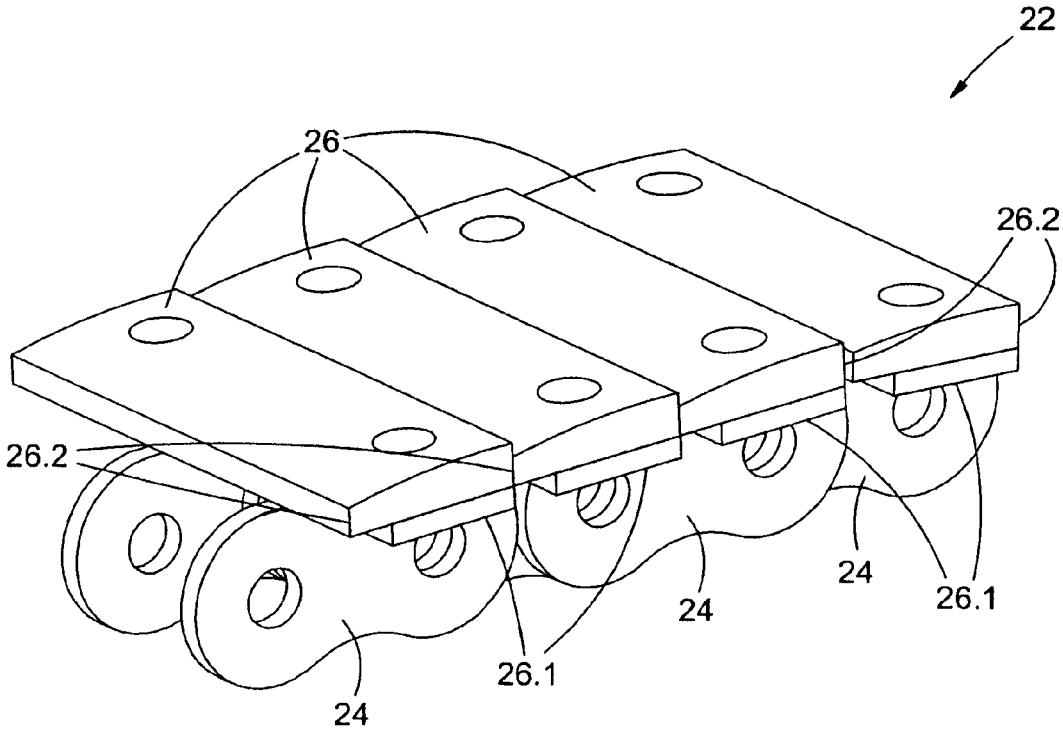
FIG. 6 is a perspective view of part of a drive chain assembly of a drive means for driving the urging member.

Referring to FIG. 6, the drive chain assembly 22 is constituted of a plurality of chain links 24 pivotally connected to each other. Each chain link 24 is provided with a retaining block 26 for abutting the retaining block 26 of a consecutive chain link 24 for rigidising the drive chain assembly 22 in all directions but one. The arrangement is such that when the drive chain assembly 22 is bent in the said one direction, the retaining blocks 26 are displaced from each other, and when the drive chain assembly 22 is in a linear configuration, adjacent retaining blocks 26 abut each other to limit bending of the drive chain assembly 22 in all but said one direction.

The configuration of the retaining blocks 26 is such that, when the blocks 26 abut each other, the drive chain assembly 22 extends in a loose curve, the arrangement being further such that, in use, the drive chain assembly 22 is stressed by straightening the curve. The retaining blocks each 26 comprises a base 26.1 for connecting to a chain link 24 and two abutment faces 26.2 extending upwardly from the base 26.1, the configuration being such that the angle between the base 26.1 and each abutment face 26.2 is marginally greater than 90 degrees. In the drawings, for the sake of clarity, only a number of chain links 24 are shown. However, it will be appreciated that the chain assembly 22 is elongate and has a length of typically between 1 and 3 meters.

Figure 4:
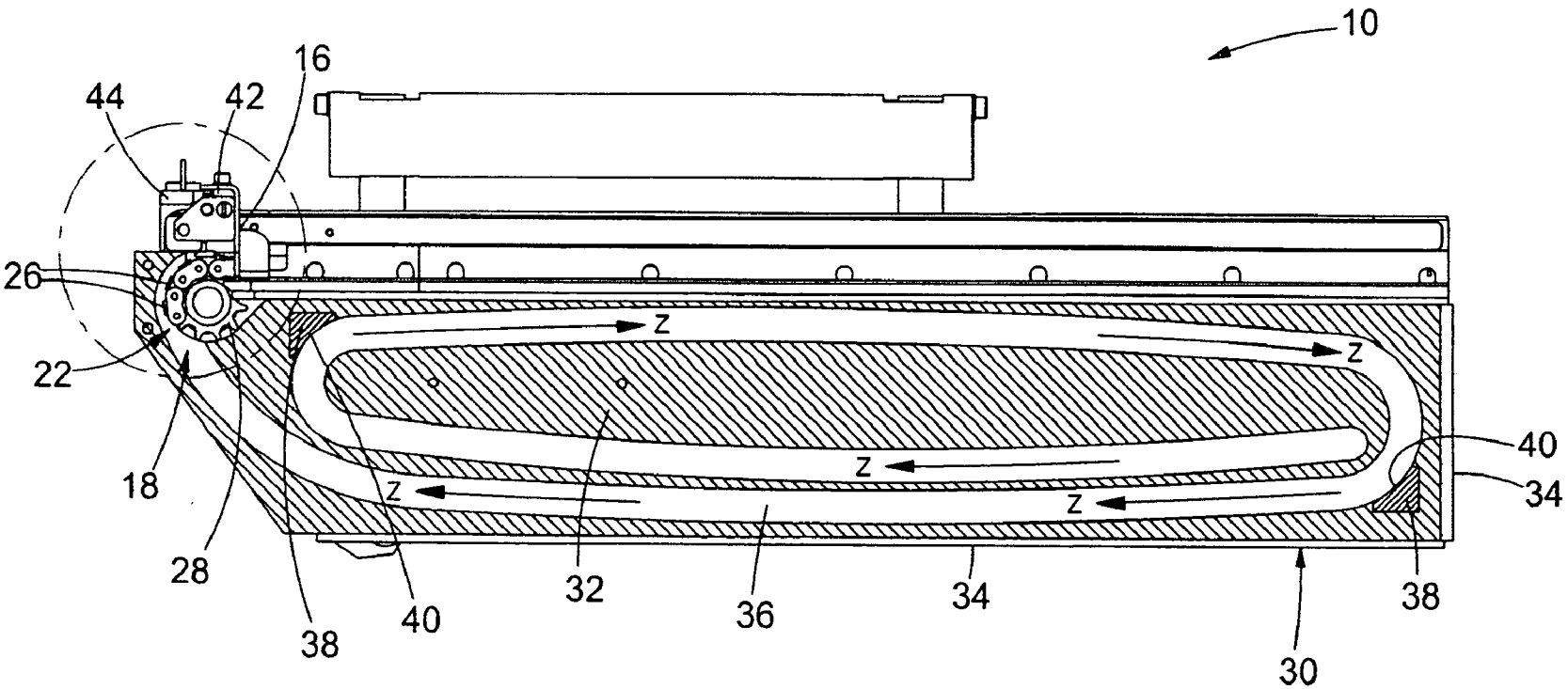
FIG. 4 is a longitudinal sectional side view of FIG. 3 without showing the projectile.

Referring particularly to FIG. 4, the ammunition loading assembly 10 includes a magazine 30 for storing the drive chain assembly 22 when the urging member 16 is in the projectile receiving position. The magazine 30 includes a polymeric block 32, in the form of polypropylene, which is covered by metal plates 34. The polymeric block 32 defines a curvilinear track 36 along which the drive chain assembly 22 moves when moving the urging member 16 between the projectile delivery position and the projectile receiving position. The magazine 30 further includes an outlet (not shown) from which the drive chain assembly 22 enters and exits. The polymeric block 32 is provided with metal reinforcing members 38 located at corners of the track 36. The metal reinforcing members 38 have curved chain guiding faces 40 for guiding the inner end (not shown) of the drive chain assembly 22 around such corners.

Figure 5:
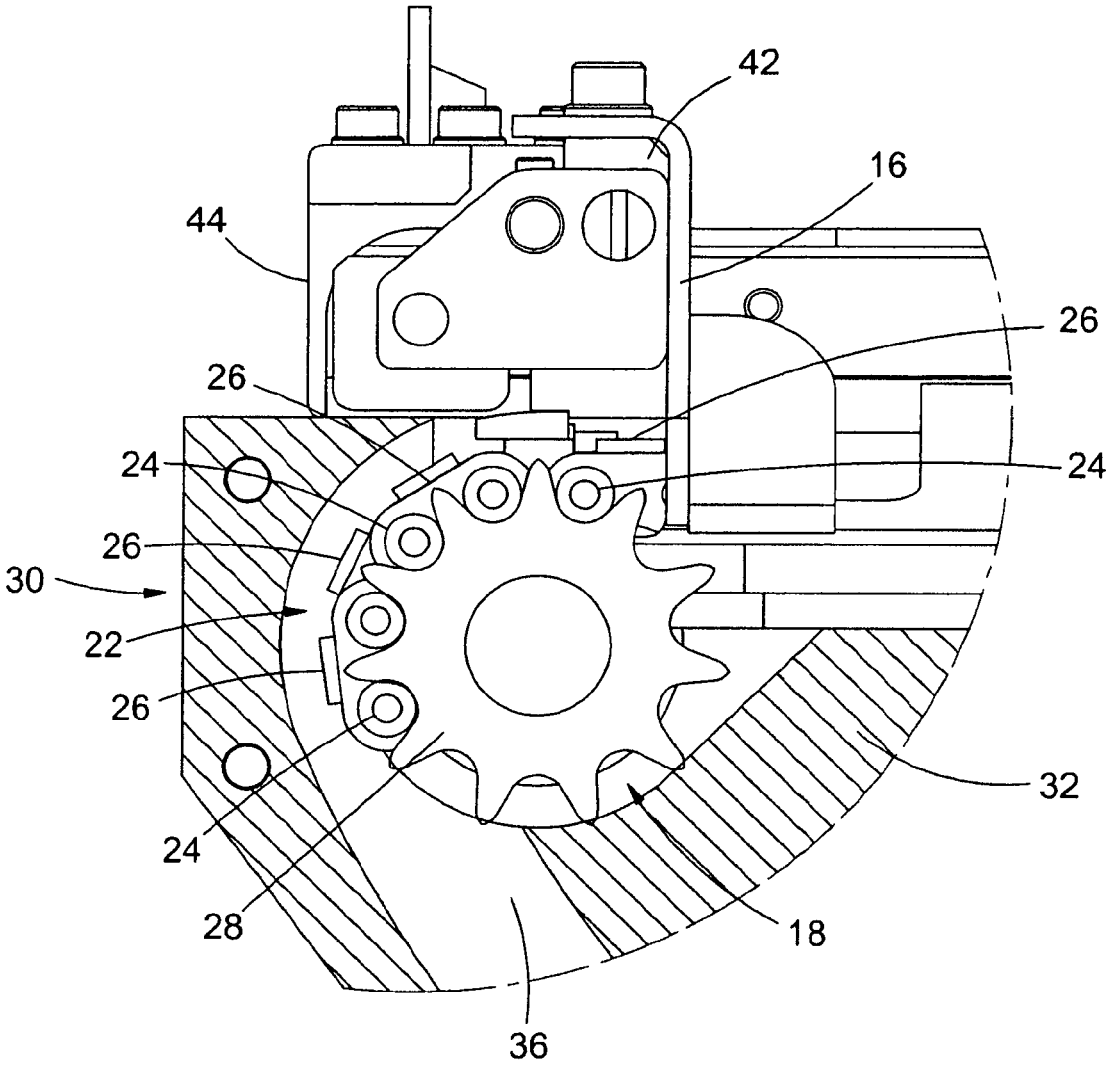
FIG. 5 is a detailed view of section A in FIG. 4.

Referring particularly to FIG. 5, the ammunition loading assembly 10 further includes first and second chain-retaining devices 42 and 44 respectively. The chain-retaining devices 42 and 44 limit curving of the drive chain assembly 22 out of its linear configuration and guide the chain 22 when moving out of the magazine 30 via the outlet, towards the projectile delivery position.

Figure 2:
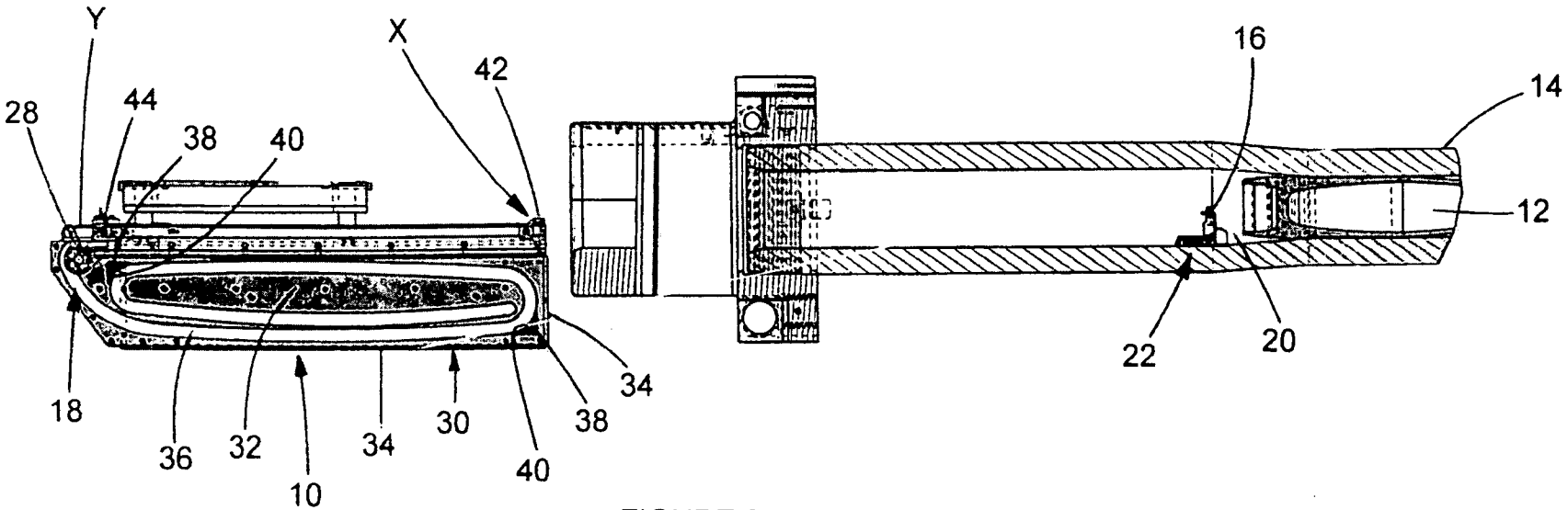
FIG. 2 is the same as that of FIG. 1 with the projectile urging member of the ammunition loading assembly in a projectile delivery position.
Figure 3:
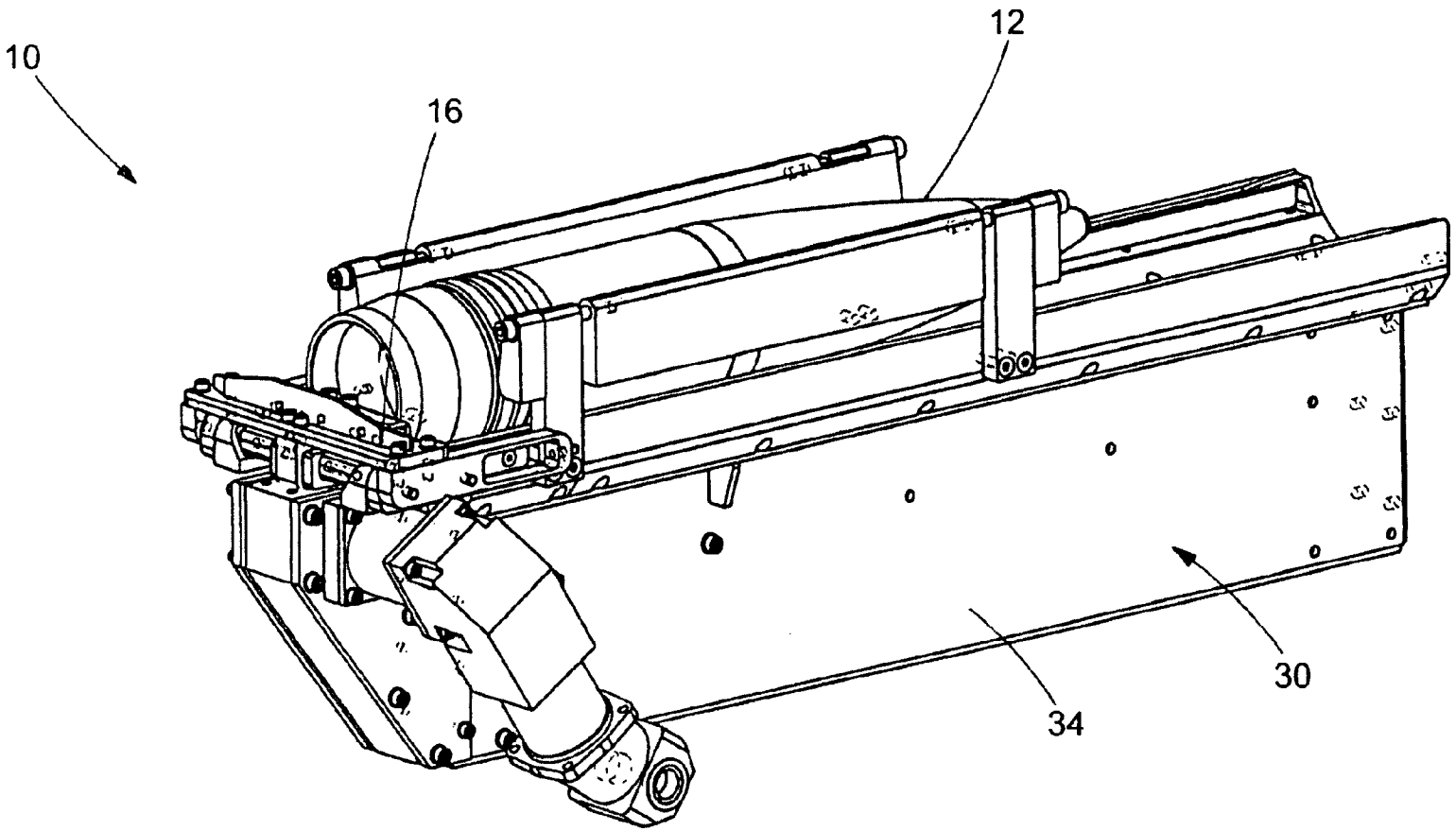
FIG. 3 is a perspective view of the ammunition loading assembly with the projectile urging member in the projectile receiving position.

Referring particularly to FIG. 2, the first chain-retaining device 42 is movable with the urging member 16 from the projectile receiving position towards a position X, intermediate the projectile receiving and delivery positions, where it is retained from further movement by a retaining means (not shown). The second chain-retaining device 44 is movable with the urging member 16 in a direction towards the projectile delivery position, from a position proximate the outlet of the magazine 30 to a position Y, offset from the said outlet.

The first and second chain-retaining devices 42 and 44 are each provided with sliding members (not shown) for engaging an upper surface of the retaining blocks 26 of the chain assembly 22 in the form of polypropylene blocks (not shown).

In use, the projectile 12 is disposed in the cradle and moved into concentric alignment with the barrel 14 of the gun. Subsequently, the projectile 12 is engraved in the barrel 14 by activating the drive motor to rotate the sprocket wheel 28 which in turn moves the drive chain assembly 22 along the track 36 in the direction of arrows Z in FIG. 4, out of the magazine 30 and thereby pushes the urging member 16 from the projectile receiving position to the projectile delivery position. As the drive chain assembly 22 pushes the urging member 16 towards the barrel 14 via the chamber 20, the first and second chain-retaining devices 42 and 44 are moved concurrently with the drive chain assembly 22 in the same direction. The second chain-retaining device 44 only moves to a position Y, which is offset from the outlet of the magazine 30 while the first chain-retaining device 42 is retained from further movement intermediate the receiving and delivery positions, at position X. The drive chain assembly 22 slides past the first and second chain-retaining devices 42 and 44 and the sliding members engage the upper surface of the retaining blocks 26 thereby guiding the drive chain assembly 22 and keeping the chain 22 in a stressed and linear configuration. The projectile 12 is delivered to the proximate end of the barrel 14 and released by the urging member, stopping just before engraving, so that the projectile engraves on rifling 15 in the barrel 14 under its own momentum. Thereafter the drive motor reverses to return the chain 22 to the projectile receiving position and collects the chain-retaining devices 42 and 44. The drive chain assembly 22 is therefore moved back along the track 36 of the magazine 30 and the chain-retaining devices 42 and 44 moved back to the position proximate the outlet of the magazine 30. After the projectile 12 is loaded into the barrel 14 of the gun, a charge (not shown) is inserted into the chamber 20 of the gun. The charge is inserted in a similar manner as the projectile.

It is foreseen that the ammunition loading assembly guides the projectile into the barrel of the gun until just before engraving. It is further foreseen that concentric alignment of the projectile with the barrel is relatively easily achieved since the position and speed of release is controlled. An advantage of the ammunition loading assembly is further that both the projectile and the charge can be loaded. Yet a further advantage of the ammunition loading assembly is that no bounce-back or fall-back occurs since the loading is controlled and the projectile loaded into the barrel of the gun.

It will be appreciated that variations in detail are possible with an ammunition loading assembly, a gun provided with such an ammunition loading assembly and a drive chain assembly for such an ammunition loading assembly according to the invention without departing from the scope of the appended claims.

The invention claimed is:

1. An ammunition loading assembly for loading a projectile into a barrel of a gun, the loading assembly comprising:

an urging member for urging the projectile into the barrel of the gun, drive means for driving the urging member between a projectile receiving position outside the barrel and a projectile delivery position inside a chamber of the gun, towards the proximate end of the barrel, the drive means including a drive chain assembly connected to the urging member for driving the urging member between the projectile receiving and delivery positions, a magazine for storing the drive chain assembly when the urging member is in the projectile receiving position, a first chain-retaining device for limiting curving of the chain assembly out of its linear orientation, when moving the urging member towards the projectile delivery position, the first chain-retaining device being movable with the urging member from the projectile receiving position towards a position intermediate the projectile receiving and delivery positions, where the first chain-retaining device is retained from further movement, and the magazine including a polymeric body of polypropylene defining a curvilinear track along which the drive chain assembly moves when moving the urging member between the projectile delivery position and the projectile receiving position, the magazine being covered by metal cover plates defining an outlet for the chain assembly and being provided with metal reinforcing members having curved chain guiding faces located at corners of the track, for guiding the inner end of the drive chain assembly around such corners.

2. An ammunition loading assembly for loading a projectile into a barrel of a gun, the loading assembly comprising:

an urging member for urging the projectile into the barrel of the gun, drive means for driving the urging member between a projectile receiving position outside the barrel and a projectile delivery position inside a chamber of the gun, towards the proximate end of the barrel, the drive means including a drive chain assembly connected to the urging member for driving the urging member between the projectile receiving and delivery positions, a magazine for storing the drive chain assembly when the urging member is in the projectile receiving position, and a first chain-retaining device for limiting curving of the chain assembly out of its linear orientation, when moving the urging member towards the projectile delivery position, the first chain-retaining device being movable with the urging member from the projectile receiving position towards a position intermediate the projectile receiving and delivery positions, where the first chain-retaining device is retained from further movement.

3. An ammunition loading assembly for loading a projectile into a barrel of a gun, the loading assembly comprising:

an urging member for urging the projectile into the barrel of the gun, drive means for driving the urging member between a projectile receiving position outside the barrel and a projectile delivery position inside a chamber of the gun, towards the proximate end of the barrel, the drive means including a drive chain assembly connected to the urging member for driving the urging member between the projectile receiving and delivery positions, a magazine for storing the drive chain assembly when the urging member is in the projectile receiving position, a first chain-retaining device for limiting curving of the chain assembly out of its linear orientation, when moving the urging member towards the projectile delivery position, the first chain-retaining device being movable with the urging member from the projectile receiving position towards a position intermediate the projectile receiving and delivery positions, where the first chain-retaining device is retained from further movement, and a second chain-retaining device, for guiding the chain when moving out of the magazine.

4. An ammunition loading assembly according to claim 3 wherein the drive chain assembly is comprised of a plurality of chain links pivotally connected to each other, and wherein each chain link is provided with a retaining block for abutting the retaining block of a consecutive chain link for rigidising the drive chain assembly in all directions but one, and wherein the first and second chain-retaining devices are each provided with at least one sliding member for engaging an upper surface of the retaining blocks of the chain assembly.

5. An ammunition loading assembly according to claim 4, wherein the sliding members each, comprises one or more polypropylene bodies.

6. An ammunition loading assembly according to claim 3, wherein the second chain-retaining device is movable with the urging member in a direction towards the projectile delivery position, from a position proximate the outlet of the magazine to a position offset from the said outlet.

7. An ammunition loading assembly for loading a projectile into a barrel of a gun, comprising:

an urging member for urging the projectile into the barrel; and drive means for driving the urging member between projectile receiving position outside the barrel and a projectile delivery position inside a chamber of the gun proximate to the end of the barrel, so that the projectile is delivered into the proximate end of the barrel where the urging member stops and the projectile is released by the urging member so that the projectile engraves on rifling the barrel under it's own momentum, the drive means including a drive chain assembly connected to the urging member for driving the urging member between the projectile receiving and delivery positions, and a first chain-retaining device for limiting curving of the chain assembly out of its linear orientation, when moving the urging member towards the projectile delivery position, the first chain-retaining device being movable with the urging member from the projectile receiving position towards a position intermediate the projectile receiving and delivery positions, where it is retained from further movement.

8. An ammunition loading assembly according to claim 7 wherein the drive chain assembly is constituted of a plurality of chain links pivotally connected to each other; and wherein each chain link is provided with a retaining block, each retaining block comprising a base for connecting to a chain link and two abutment faces extending upwardly from the base, the angle between the base and each abutment face being marginally greater than 90 degrees, so that each retaining block abuts the retaining block of a consecutive chain link to make the drive chain assembly rigid in all directions but one, such that when the drive chain assembly is bent in the one direction, the retaining blocks are displaced from each other, and when the drive chain assembly is in a linear configuration, adjacent retaining blocks abut each other to limit bending of the drive chain assembly in all but said one direction, the retaining blocks being configured so that, when the blocks abut each other, the drive chain assembly extends in a loose curve, and when the curve is straightened the drive chain assembly is stressed.

9. A gun including an ammunition loading assembly according to claim 7.

10. An ammunition loading assembly for loading a projectile into a barrel of a gun, the loading assembly comprising an urging member for urging the projectile into the barrel;

drive means for driving the urging member between a projectile receiving position outside the barrel and a projectile delivery position inside a_chamber of the gun, proximate to the end of the barrel, so that the projectile is delivered into the proximate end of the barrel where the urging member stops and the projectile is released by the urging member so that the projectile engraves on rifling in the barrel under its own momentum, the drive means including a drive chain assembly connected to the urging member for driving the urging member between the projectile receiving and delivery positions, a first chain-retaining device for limiting curving of the chain assembly out of its linear orientation, when moving the urging member towards the projectile delivery position, the first chain-retaining device being movable with the urging member from the projectile receiving position towards a position intermediate the projectile receiving and delivery positions, where it is retained from further movement, and a second chain-retaining device, for guiding the chain when moving out of the magazine.

11. An ammunition loading assembly according to claim 10 wherein the drive chain assembly is comprised of a plurality of chain links pivotally connected to each other, and wherein each chain link is provided with a retaining block for abutting the retaining block of a consecutive chain link for rigidising the drive chain assembly in all directions but one, and wherein the first and second chain-retaining devices are each be provided with at least one sliding member for engaging an upper surface of the retaining blocks of the chain assembly.

12. An ammunition loading assembly according to claim 11 wherein the sliding members each comprises one or more polypropylene bodies.

13. An ammunition loading assembly according to claim 10 wherein the second chain-retaining device is movable with the urging member in a direction towards the projectile delivery position, from a position proximate the outlet of the magazine to a position offset from the said outlet.

* * * * *